US007284671B1

(12) United States Patent
Doscher

(10) Patent No.: US 7,284,671 B1
(45) Date of Patent: Oct. 23, 2007

(54) RECREATIONAL BOARD RACK SYSTEM

(76) Inventor: Wanda Doscher, 3037A Cambridge Rd., Cameron Park, CA (US) 95628

( * ) Notice: Subject to any disclaimer, the term of this patent is extended or adjusted under 35 U.S.C. 154(b) by 0 days.

(21) Appl. No.: 11/120,521

(22) Filed: Apr. 29, 2005

(51) Int. Cl.
*A47F 5/08* (2006.01)

(52) U.S. Cl. ..... 211/59.1; 211/32; 211/60.1; 211/70.5; 211/85.7; 211/106.01; 248/201

(58) Field of Classification Search ..... 211/32, 211/106.01, 85.3, 85.6, 85.11, 35, 64, 68, 211/70.2, 94.03, 103, 87.01, 59.1, 70.5, 85.7; 248/490, 48.2
See application file for complete search history.

(56) References Cited

U.S. PATENT DOCUMENTS 2,066,822 A * 1/1937 Cohen ..... 211/13.1
4,566,662 A * 1/1986 Toshishige ..... 248/222.14
5,082,123 A 1/1992 Lamb
5,141,116 A 8/1992 Mojica
5,727,698 A * 3/1998 Lai ..... 211/87.01
5,833,079 A 11/1998 Roberts
5,950,844 A 9/1999 Taylor
6,161,707 A * 12/2000 Lin ..... 211/87.01
6,390,309 B1 5/2002 Tucker
6,439,404 B1 8/2002 Steeg
6,695,154 B2 2/2004 Jacobs
2004/0020881 A1 2/2004 Wuerth

* cited by examiner

*Primary Examiner*—Richard E. Chilcot, Jr.
*Assistant Examiner*—Jared W. Newton

(57) ABSTRACT

A system for storing recreational boards on a wall is disclosed, and comprises at least one recreational board storage rack for supporting a recreational board on a wall surface. The recreational board storage rack comprises a base plate for mounting on a wall surface and at least one support hook removably mounted on the base plate. The base plate has front and rear faces, and at least one aperture extending between the front and rear faces of the base plate. At least one depression is formed in the rear face of the base plate. The support hook comprises a hook portion removably positioned in the aperture and an anchor portion removably positioned in the depression of the base plate such that the support hook extends from the rear face to the front face of the base plate.

3 Claims, 3 Drawing Sheets

RECREATIONAL BOARD RACK SYSTEM

BACKGROUND OF THE INVENTION

1. Field of the Invention

The present invention relates to specialized racks for holding items, and more particularly pertains to a new recreational board rack system for securely supporting a recreational board, such as a skateboard, snowboard, wakeboard, or surfboard, on a wall.

2. Description of the Prior Art

The use of special purpose racks for holding particular items is known in the prior art. However, the storage of recreational boards, such as skateboards, snowboards, wakeboards, surfboards, water or snow skis, presents particular challenges that are not present in other items.

First, recreational boards tend to be heavy, so any rack that is designed to support a recreational board should be able to support a large amount of weight. This presents an especially difficult problem for wall-mounted racks, as the weight of the recreational board (and the rack) is typically cantilevered away from the surface of the wall.

Second, a further problem presented by wall-mounted recreational board racks is that placing the recreational board on the rack and removing it from the rack may allow the recreational board to come into contact with the wall, possibly scuffing or impacting the wall surface. Thus, the rack should protect the wall surface as much as possible from potential scuffs or impacts from the recreational board as it is placed on or removed from the rack.

Third, recreational board racks that are sufficiently strong can tend to be heavy and bulky and difficult to transport, so a compact and relatively light racks is highly desirable.

In these respects, the recreational board rack according to the present invention substantially departs from the conventional concepts and designs of the prior art, and in so doing provides an apparatus primarily developed for the purpose of securely supporting a recreational board or other recreational item on a wall.

SUMMARY OF THE INVENTION

In view of the foregoing disadvantages inherent in the known types of specialized racks now present in the prior art, the present invention provides a new recreational board rack construction wherein the same can be utilized for securely supporting a recreational board or other recreational item on a wall.

To attain this, the present invention generally comprises a system for storing recreational boards on a wall, and comprises at least one recreational board storage rack for supporting a recreational board on a wall surface. The recreational board storage rack comprises a base plate for mounting on a wall surface and at least one support hook removably mounted on the base plate. The base plate has front and rear faces, and at least one aperture extending between the front and rear faces of the base plate. At least one depression is formed in the rear face of the base plate. The support hook comprises a hook portion removably positioned in the aperture and an anchor portion removably positioned in the depression of the base plate such that the support hook extends from the rear face to the front face of the base plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the provision for securely mounting the rack to a wall in a manner that resists the separation of the rack system from the wall, even when relatively heavy items such as recreational boards, are placed on the rack system as well as removed from the rack system. The rack system of the invention also functions to separate the supported recreational board from the wall surface to minimize the possibility of marring or otherwise damaging the wall. Still further, the rack system of the invention has the ability to be disassembled into a much smaller size than its assembled size, to facilitate the initial shipping or delivery to the ultimate user as well as subsequent storage or transport by the user.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
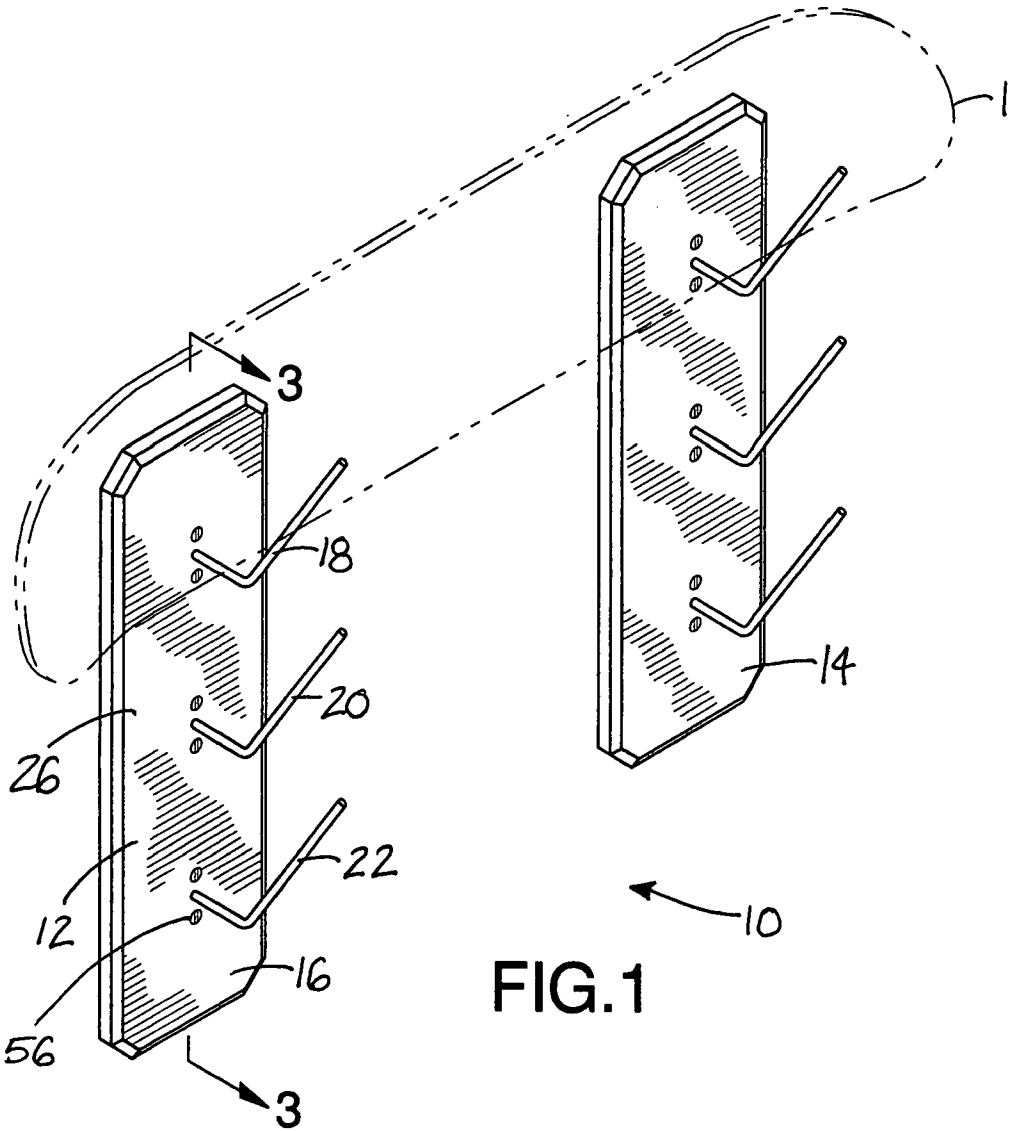
FIG. 1 is a schematic front perspective view of a new recreational board rack system according to the present invention.
Figure 2:
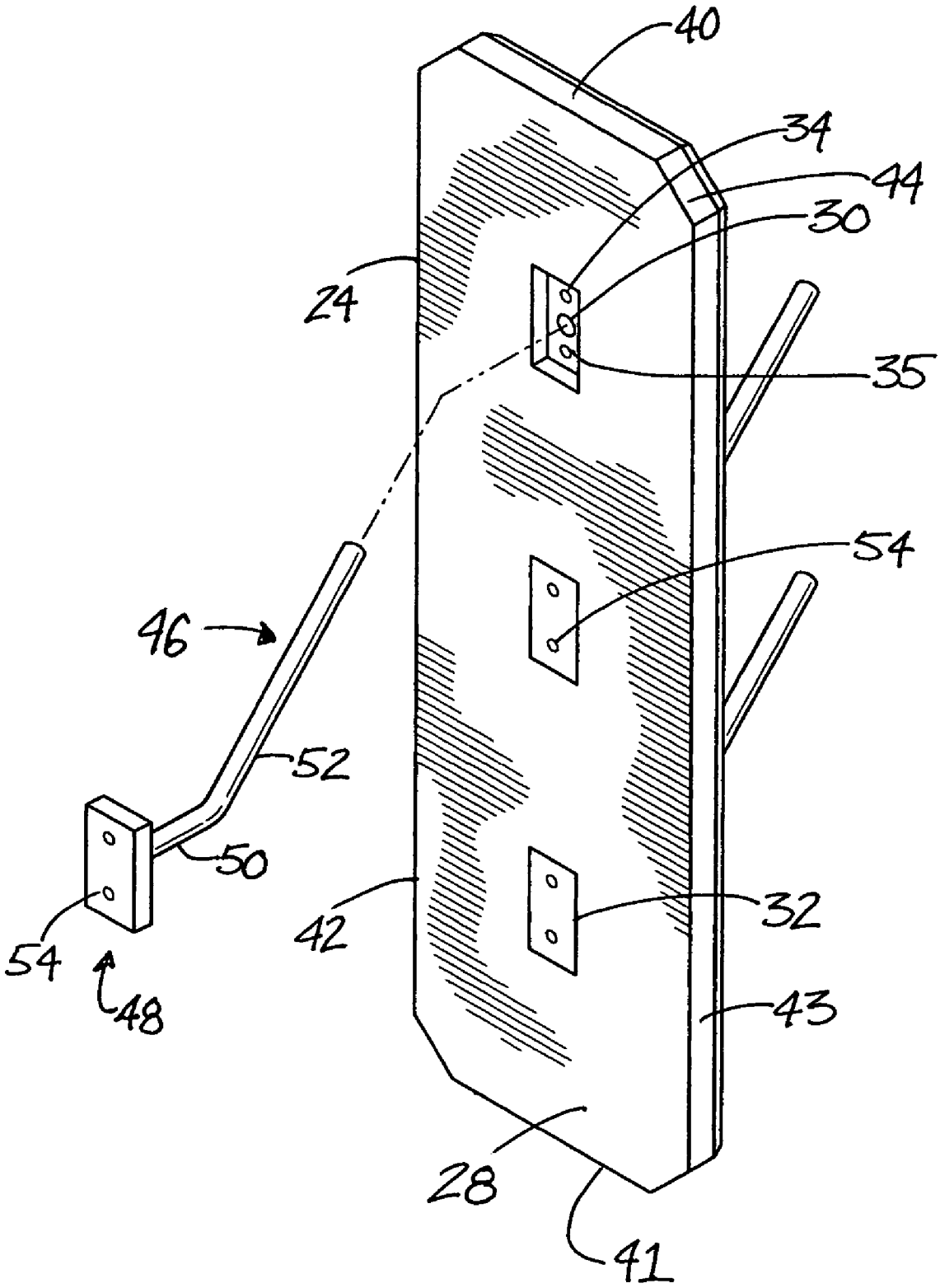
FIG. 2 is a schematic rear perspective exploded view of the present invention.
Figure 3:
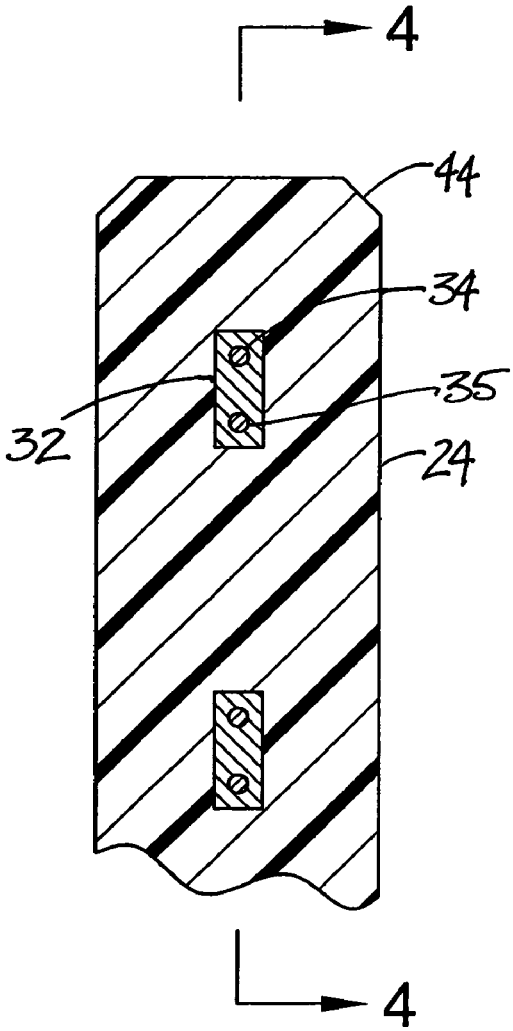
FIG. 3 is a schematic sectional view of the present invention.
Figure 4:
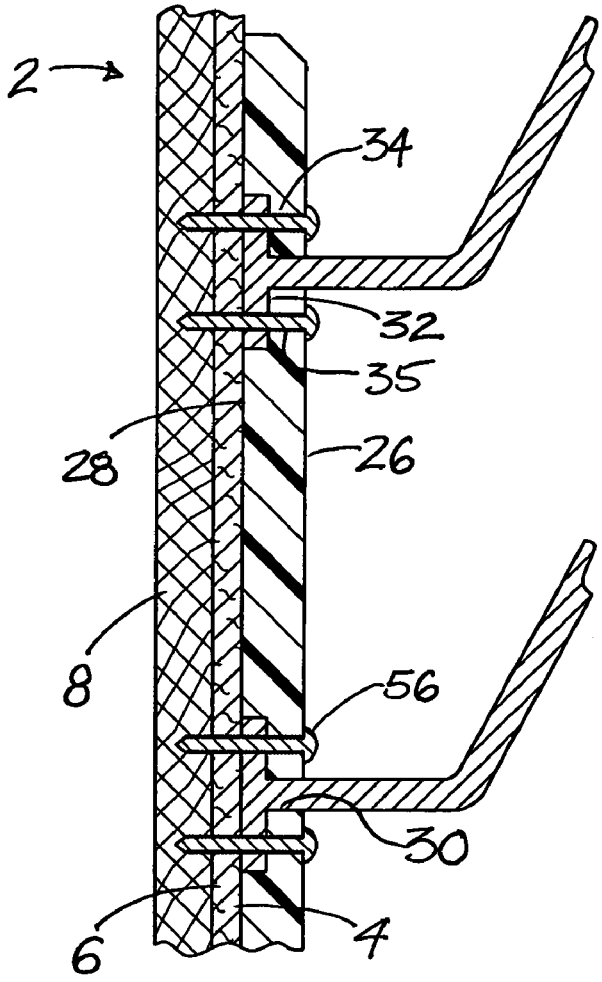
FIG. 4 is a schematic sectional view of the present invention taken along line 4—4 of FIG. 1.

With reference now to the drawings, and in particular to FIGS. 1 through 4 thereof, a new recreational board rack system embodying the principles and concepts of the present invention and generally designated by the reference numeral 10 will be described.

As best illustrated in FIGS. 1 through 4, the recreational board rack system 10 is highly suitable for supporting one or more recreational boards on a vertical surface, such as the wall 2 of a structure. The system 10 generally comprises at least one, and in most embodiments at least two, recreational board storage racks 12, 14. Each recreational board storage rack 12, 14 generally comprises a base plate 16 for mounting against a vertical surface and at least one, and in many embodiments two or more, support hooks 18, 20, 22 for engaging recreational boards in a supportive manner.

While the system 10 typically employs two or even more of the recreational board storage racks 12, this description will be directed to one of the racks 12 with the understanding that other racks will be identical, or substantially similar, to the one rack 12 being described. The pair of recreational board storage racks 12 may be mounted in a laterally spaced, and substantially parallel, orientation on a wall 2.

The base plate 16 is mountable on a surface 4 on a wall 2. The base plate has a thickness of between about one-quarter inch and one inch which functions to separate a recreational board 1 supported on the support hooks 18 and the surface 4 of the wall 2. The base plate 16 has an outer perimeter 24, with a front face 26 and a rear face 28. The outer perimeter 24 may include a pair of end edges 40, 41 and a pair of side edges 42, 43, with the pair of side edges extending between the pair of end edges. The side edges 42, 43 and end edges 40, 41 may have respective edge surfaces. Optionally, the outer perimeter 24 may include bevel edges 44 that extend between adjacent end and side edges. As a further option, the surface of the base plate 16 may be beveled from the front face 26 of the base plate toward the edge surface of the base plate. In some of the most preferred embodiments of the invention, the base plate 16 is formed of a plastic, but the base could also be formed of other materials, such as wood or a wood-containing material.

At least one aperture 30 extends through the base plate 16 and between the front 26 and rear 28 faces of the base plate. The shape of the aperture may be substantially cylindrical, and the aperture may be substantially centered on the base plate 16. In embodiments of the invention where two support hooks 18, 20 are included, the base plate 16 includes at least two of the apertures. In one of the most preferred embodiments, the base plate 16 includes three apertures 30, and the apertures are substantially uniformly spaced from each other.

The base plate 16 may include at least one depression 32 that is formed in the rear face 28 of the base plate for receiving the anchor portion of the support hook described in greater detail below. The depression 32 is positioned about the aperture 30 in the base plate 16. The depression 32 may have a substantially rectangular perimeter shape, and may have a substantially uniform depth.

The base plate 16 may also include at least one fastener hole 34 that extends through the base plate and between the faces 26, 28 of the base plate. The fastener hole 34 is positioned adjacent to the aperture 30, and the fastener hole may be in communication with the depression 32. In some embodiments of the invention, at least two fastener holes 34, 35 are associated with the aperture 30, and the two fastener holes may be located on opposite sides of the aperture.

The support hooks 18, 20, 22 of the invention are preferably removably mounted on the base plate 16, so that each of the storage racks 12, 14 may be collapsed into a more compact form during initial transport to the consumer, and during storage by the consumer between uses. A portion of each support hook 18, 20, 22 extends through one of the apertures 30 in the base plate 16 so that the hook extends from the rear of the base plate to the front of the base plate, and then extends outwardly from the front face 26.

Each of the support hooks 18, 20, 24 may include a hook portion 46 and an anchor portion 48. A part of the hook portion 46 may be removably positioned in the aperture 30 and the anchor portion may be removably positioned in the depression 32 of the base plate 16. The interface between the part of the support hook 18 and the base plate 16 in the aperture 30 reinforces the connection between the support hook and the base plate. At the point at which the hook portion 46 is connected to the anchor portion 48, the hook portion may be oriented substantially perpendicular to the anchor portion.

The hook portion 46 may include a primary section 50 and a secondary section 52. The primary section 50 may be oriented substantially perpendicular to the anchor portion 48. The secondary section 52 may be angled with respect to the primary section 50 at an angle, so that the secondary section extends upwardly when the rack is mounted on a wall. The angle between the primary 50 and secondary 52 sections may range between approximately 120 degrees and approximately 150 degrees. The length of the primary section 50 may be shorter than the length of the secondary section, and in some embodiments, the length of the secondary section is at least approximately twice the length of the primary section. In one illustrative embodiment of the invention, the primary section 50 measures approximately 4.5 inches long, and the secondary section 52 measures approximately 11 inches long.

The anchor portion 48 may comprise a substantially uniformly thick plate. At least one hole 54 may be formed in the anchor portion for aligning with the fastener hole 34 in the base plate 16.

At least one fastener 56 may be employed to mount the rack 12 on the wall 2, and the fastener may be extended through the fastener hole 34 in the base plate 16 and through the hole 54 in the anchor portion 48 of the support hook 18. This configuration thus not only attaches the anchor portion 48 of the support hook 18 to the base plate 16, but also attaches the support hook 18 directly to the wall 2, so that the force of the weight of the recreational board is borne directly by the wall. In highly preferred installations, the fastener 56 is not only extended into the surface layer 6 of the wall 2, but also extends into a stud 8 of the wall. In this configuration, the stud supports the support hook virtually directly, as the anchor portion 48 is abuttable against the wall surface and the fastener 56 passes through the anchor portion into the stud.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for storing recreational boards on a wall, comprising: at least one recreational board storage rack for supporting a recreational board on a wall surface, the recreational board storage rack comprising:

a base plate for mounting on a wall surface, the base plate having a front face and a rear face, at least one aperture extending between the front and rear faces of the base plate, at least one depression being formed in the rear face of the base plate;

at least two support hooks removably mounted on the base plate, a portion of each support hook extending through the aperture in the base plate, each support hook comprising a hook portion removably positioned in the aperture and an anchor portion removably positioned in the depression of the base plate such that each support hook extends from the rear face to the front face of the base plate;

wherein the hook portion and the anchor portion of the hook are integrally formed from the same piece of material;

wherein at least one section of the hook portion of each support hook is angled with respect to an axis oriented perpendicular to the anchor portion of each support hook; wherein each support hook is separate from all other support hooks;

wherein each of the hook portions includes a primary section and a secondary section, the primary section being oriented substantially perpendicular to the anchor portion, and the secondary section being angled with respect to the primary section such that the angle between the primary section and the secondary section is between approximately 135 degrees and approximately 165 degrees;

wherein the primary section has a length and the secondary section has a length, the length of the secondary section is at least approximately twice the length of the primary section;

wherein at least one fastener hole is formed in the base plate;

wherein at least one hole is formed in the anchor portion of each support hook, the at least one hole in the anchor portion being axially aligned with the at least one fastener hole in the base plate and at least one fastener extending through the at least one fastener hole in the base plate and through the at least one hole in the anchor portion;

wherein the at least one fastener hole is positioned adjacent to the aperture;

wherein the at least one fastener hole is in communication with the depression;

wherein at least two fastener holes are associated with the aperture, the at least two fastener holes being located on opposite sides of the aperture;

wherein the base plate includes three of the apertures;

wherein said apertures in the base plate are substantially circular;

wherein said apertures are surrounded continuously by the base plate; and wherein the anchor portion of each support hook fits substantially completely in the depression in the base plate.

2. The system of claim 1 comprising a pair of the recreational board storage racks.

3. The system of claim 1, wherein the at least two support hooks comprises three support hooks, each of the support hooks being separate of the other two support hooks; and wherein the primary and secondary sections of each hook portion are each substantially linear between ends.

* * * * *